United States Patent [19]

Elliott

[11] Patent Number: 4,527,947

[45] Date of Patent: Jul. 9, 1985

[54] SEAL-FREE IMPELLER PUMP FOR FLUIDS CONTAINING ABRASIVE MATERIALS OR THE LIKE

[76] Inventor: Eric R. Elliott, 58 Argyle St. N., Renfrew, Ontario, Canada, K7V 1S8

[21] Appl. No.: 581,329

[22] Filed: Feb. 17, 1984

[51] Int. Cl.[3] ..... F03B 13/10; F04D 7/06

[52] U.S. Cl. ..... 415/121 B; 415/121 G; 415/213 A; 415/170 B; 415/98

[58] Field of Search ..... 415/121 B, 121 G, 213 A, 415/98, 97, 170 B, 113

[56] References Cited

U.S. PATENT DOCUMENTS 2,207,317 7/1940 Gear ..... 415/97
2,890,660 6/1959 Umbricht ..... 415/121 B
3,154,019 10/1964 Hoyt ..... 415/199.3
3,171,357 3/1965 Egger ..... 415/213 A

*Primary Examiner*—Robert E. Garrett
*Assistant Examiner*—H. Edward Li
*Attorney, Agent, or Firm*—Murray Schaffer

[57] ABSTRACT

A submersible impeller pump capable of pumping fluids carrying materials such as sand, stones, sewage, and which requires little or no maintenance is provided. The pump includes a housing having an impeller unit including arcuate vanes, eccentrically mounted therein, the impeller having a pair of circular expeller faces on each side of the arc-shaped vanes, in order to effect water seals within the pump housing, to eliminate the need for mechanical seals. Thus, only the motor driving the pump need be sealed, when submersed, the pump itself requiring no critical bearings or seals.

6 Claims, 4 Drawing Figures

SEAL-FREE IMPELLER PUMP FOR FLUIDS CONTAINING ABRASIVE MATERIALS OR THE LIKE

The submersible impeller pump according to the invention is designed to handle fluids carrying materials such as sand, stones, sewage, or other abrasives, and to provide a pump which is substantially maintenance free.

The pump is also free of seals, and is capable of running indefinitely without water as well as in water.

These and other advantages will become apparent in the light of the following description.

An object of the invention is to provide a submersible pump, only the motor of which is sealed.

A further object is to provide a pump capable of handling fluid material which carries abrasive substances such as sand, stones, construction debris or the like.

A further object is to provide a pump which will not be damaged if frozen while submersed, or full of fluid, and which is capable of being thawed by direction application of flame or heat.

A still further object is to provide means to free the pump according to the invention in the case where the pump is stopped, while pumping heavy sand or mud which may back flow from the discharge hose to cause a blockage within the pump.

A still further object is to provide a pump which does not require seals.

A principal object of the invention is to provide an impeller pump comprising: a unitary pump housing; an impeller unit adapted for rotation within said housing; said pump housing having a peripheral wall and a top, and having an open bottom, with motor mounting means on the top thereof, adapted to support a motor thereon in axial alignment with said impeller unit, said motor including a drive shaft adapted to project through said motor mount and the top of said housing for connection with said impeller unit; said impeller comprising a pair of spaced-apart circular expeller faces each having a plurality of outer, unitary, radial, wedge-shaped vanes around the circumferences thereof with a plurality of arc-shaped impeller vanes between said circular faces, said impeller being eccentrically mounted within said housing; a bottom plate, adapted to be removably engaged on the open bottom of said housing, said bottom plate having an opening therein in axial alignment with the centre of said impeller; a pair of stationary circular expeller plates closely spaced from said expeller faces of said impeller, within the housing; the face of said impeller facing the open side of said pump housing having a central opening for fluid ingress; and said housing having an opening for fluid egress on the top thereof near the peripheral wall thereof.

A preferred embodiment of the pump will now be described with reference to the following drawings, wherein.

Detailed reference will now be made to the drawings wherein like reference numerals will identify like parts.

Figures 1, 2:
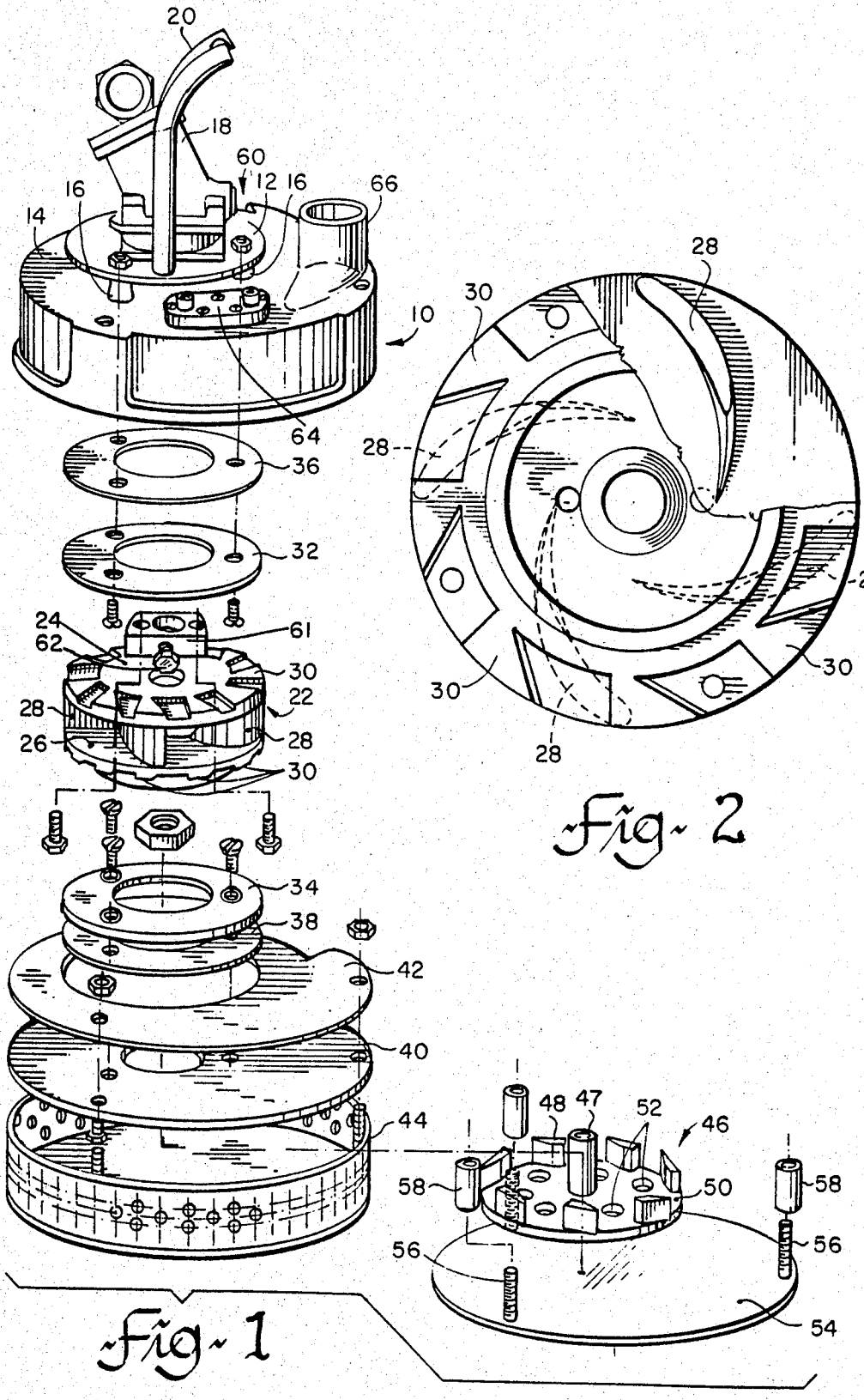
FIG. 1 is an exploded view.
FIG. 2 is an enlarged segemented view of an impeller for use in the pump.
Figure 3:
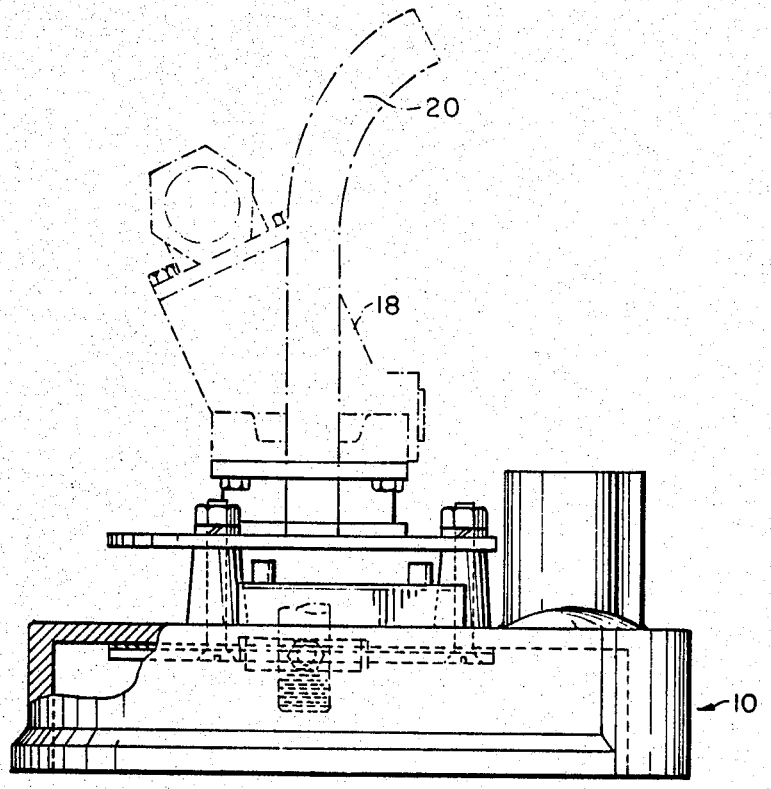
FIG. 3 is a side elevation of the pump, partly in section.
Figure 4:
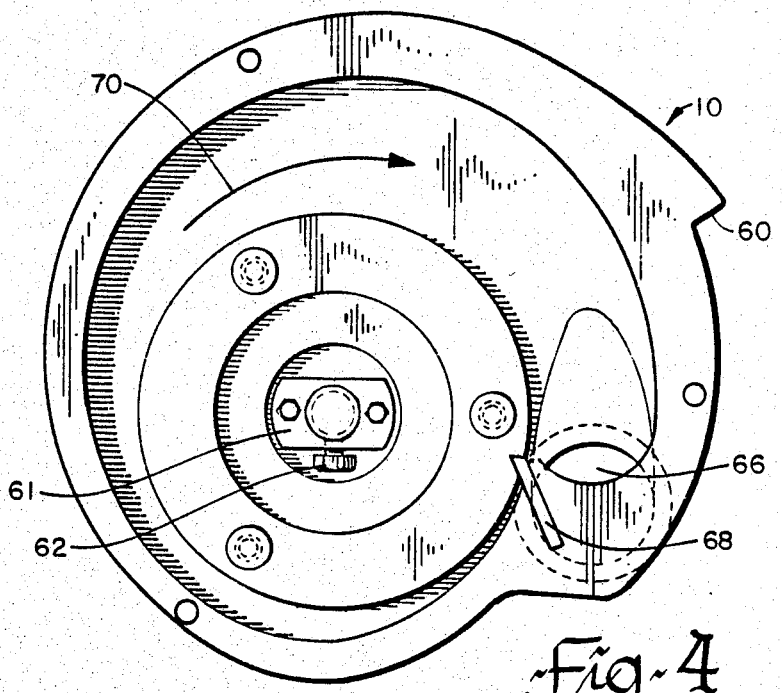
FIG. 4 is a bottom plan of the pump casing, with the impeller not illustrated.

In FIGS. 1, 3 and 4 the pump casing is indicated generally at 10. Casing 10 is a unitary casting of aluminum magnesium, or the like, and as seen in FIG. 4 is open at its bottom.

A motor mounting plate 12 is spaced above the top 14 of casing 10 by three spacers 16, only two of which are visible in FIG. 1. Spacers 16 are unitary with the pump casing 10, and provide a seat for motor mount plate 12, and are also of value during machining procedures as the casing itself is manufactured. A motor 18 is illustrated in FIG. 1, being an hydraulic motor, is affixed to motor mounting plate 12. As will be evident to those skilled in the art, air or electric motors may also be used, as circumstances dictate. Projecting upwardly from motor mount plate 12 is a handle 20 which may be configured as required, again depending on the application to which the pump is to be put.

As seen in FIG. 1, an impeller unit indicated generally at 22 is adapted for rotation within casing 10.

Impeller 22 includes upper and lower expeller faces 24 and 26 respectively with a plurality of arc-shaped impeller vanes 28 therebetween. For simplicity of manufacture, impeller vanes 28 are unitarily cast with one of expeller faces 24 and 26, with the second expeller face being subsequently affixed thereto by countersunk screws as will be evident to one skilled in the art.

Both expeller faces 24 and 26 are provided with a plurality of small wedge-shaped radially extending vanes 30 around the circumferences thereof on the sides of diffuser plates 24 and 26 remote from impeller vanes 28, wedge-shaped vanes 30 being unitary with faces 24 and 26 and vanes 30 having slightly sloped leading edges.

Referring again to FIG. 1, an upper expeller plate 32 and a lower expeller plate 34 manufactured of hard steel plate, are equal in diameter to the diameter of impeller 22, and when the pump is assembled expeller plates 32 and 34 are closely spaced from vanes 30 of expeller faces 24 and 26 respectively, so as to provide minimum clearance.

A pair of gaskets 36, 38 may be provided above and below expeller plates 32, 34 respectively, so as to permit adjustment of the spacing between the expeller plates 32, 34 and the faces 24, 26 of the impeller 22. Gaskets 36, 38 are preferably of asbestos or other heat-resistant material so as to permit use of direct flame in the event the pump requires thawing if frozen.

Vanes 30 provided on the faces 24, 26 of impeller 22, in combination with the closely spaced expeller plates 32, 34, during rotation of impeller 22 within casing 10, will build a higher centrifugal pressure than the pressure created by arc-shaped impeller vanes 28 which effect actual pumping of fluid, thus eliminating the need of water seals above and below impeller 22 as required in impeller pumps known heretofore.

A bottom plate 40, with a central aperture in axial alignment with impeller 22 (and motor 18) and a gasket 42, of asbestos or the like serve to close the bottom periphery of pump housing 10.

A protective screen 44 may be provided, for attachment to the bottom of the pump assembly, with screen 44 having a mesh size appropriate to the use to which the pump is to be put.

Alternatively, protective screen 44 may be removed, and a rotating chopper indicated generally at 46 in FIG. 1 be employed. Chopper 46 is adapted to be connected to and driven by motor 18 by upwardly projecting axial connector 47. Chopper teeth 48 projecting upwardly around the circumference of chopper plate 50 serve to chop debris encountered, such as construction debris, or the like. Chopper plate 50 is provided with bottom perforations 52. When chopper 46 is employed, a supporting base plate 54 is affixed to plate 40 by means of bolts 56 having co-operating collar spacers 58 so that the entire pump assembly may rest on bottom plate 54 when the pump is not otherwise suspended, as by handle 20. Pump casing 10 is provided with a projecting starting lug 60 (see FIGS. 1 and 4). Starting lug 60 is a unitary projection of pump casing 10, and is provided to effect start-up of the pump, in the event the pump becomes clogged after use and shut-down. When the motor is running a simple blow of a hammer on lug 60 effects a sharp jerk on the casing 10 in the opposite direction to the direction of rotation of impeller 22, frees the impeller to rotate under power, and thus eliminates the need to disassemble the protection screen 44, or remove chopper 46, for cleaning purposes.

Impeller 22 is engaged with the drive shaft of motor 18 by means of a block 61, which is secured to the face 24 of impeller 22 by means of countersunk bolts, and which is secured to the shaft of motor 18 by means of set screw 62, thus permitting vertical adjustment of impeller 22 relative to upper expeller plate 32 so that minimum clearance therebetween is achieved.

In order to reduce wear at outlet 66, a diffuser finger 68, of hard steel is provided (see FIG. 4). Finger 68 is provided to diffuse or break solid matter reaching the bottom of outlet 66 to eliminate any possibility of blockage in the outlet hose or pipe (not illustrated).

Prototype pumps have been constructed according to the above structure, and have operated without breakdown or the need for any servicing over a period of several months, in large drainage situations where fluid being pumped has been relatively polluted with sand, gravel, and construction debris. Prototype pumps have served in such circumstances during summer and Canadian winter temperatures.

As has been discussed above, only the motor driving the pump needs to be sealed from water in which it is submersed. The pump itself does not require any critical bearings or seals and functions efficiently with fluid being raised through the central aperture provided in bottom plate 40, associated expeller plate 34 and the central aperture in impeller 22, and is impelled centrifugally under the urging of impeller vanes 28 around the interior or casing 10 in the direction of arrow 70 of FIG. 4 to emerge under pressure from outlet 66.

As has already been described, faces 24 and 26 of impeller 22 which are closely spaced from expeller plates 32 and 34 effect a centrigual pressure which is higher than the pressure effected by the impeller vanes 28, and thus create water seals above and below impeller 22 eliminating the requirement for mechanical seals as is traditional in impeller pumps. Further, the outward thrust created by the sloped leading edges of truncated wedge-shaped radial vanes 30 on faces 24 and 26 of impeller 27 enhance the water seal created thereby.

The foregoing is by way of example only and the invention should be limited only by the scope of the appended claims.

The embodiments of the invention in which an exclusive property or privilege is claimed are defined as follows:

1. An impeller pump comprising:

a unitary pump housing;

an impeller unit adapted for rotation within said housing;

said pump housing having a peripheral wall and a top, and an open bottom, with motor mounting means on the top thereof, adapted to support a motor thereon in axial alignment with said impeller unit, said motor including a drive shaft adapted to project through said motor mount and the top of said housing for connection with said impeller unit;

said impeller comprising a pair of spaced-apart circular expeller faces each having a plurality of outer, unitary, radial, wedge-shaped vanes around the circumferences thereof with a plurality of arc-shaped impeller vanes between said circular faces, said impeller being eccentrically mounted within said housing;

a bottom plate, adapted to be removably engaged on the open bottom of said housing, said bottom plate having an opening therein in axial alignment with the centre of said impeller;

a pair of stationary circular expeller plates closely spaced from said expeller faces of said impeller, within the housing;

the face of said impeller facing the open side of said pump housing having a central opening for fluid ingress; and said housing having an opening for fluid egress on the top thereof near the peripheral wall thereof.

2. An impeller pump according to claim 1, said pump housing including a unitary projection on the exterior of its wall, said projection having a flat vertical side facing in the direction of rotation of said impeller.

3. An impeller pump according to claim 1, a circular chopper plate having a plurality of upwardly projecting teeth around the periphery thereof and an upwardly projecting axial connector for connection to said motor and being adapted for rotation below the open side of said pump housing.

4. An impeller pump according to claim 3, a base plate being affixed to the open side of said housing below said chopper.

5. An impeller pump according to claim 1, a cylindrical mesh screen being removably affixed to said open side of said pump housing.

6. An impeller pump according to claim 1, said opening for fluid egress in said housing having a diffuser finger of hard steel mounted therein to diffuse solid material passing therethrough.

* * * * *